US009176408B2

(12) United States Patent
Kadokura et al.

(10) Patent No.: US 9,176,408 B2
(45) Date of Patent: Nov. 3, 2015

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yasuo Kadokura, Kanagawa (JP); Emi Matsushita, Kanagawa (JP); Hiroyoshi Okuno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 12 days.

(21) Appl. No.: 14/026,437

(22) Filed: Sep. 13, 2013

(65) Prior Publication Data

US 2014/0295339 A1 Oct. 2, 2014

(30) Foreign Application Priority Data

Mar. 26, 2013 (JP) ..... 2013-065023

(51) Int. Cl.

| | |
|---|---|
| ***G03G 9/097*** | (2006.01) |
| ***G03G 9/093*** | (2006.01) |
| ***G03G 9/08*** | (2006.01) |
| *G03G 15/08* | (2006.01) |

(52) U.S. Cl.

CPC ..... *G03G 9/09321* (2013.01); *G03G 9/0819* (2013.01); *G03G 9/09371* (2013.01); *G03G 9/09392* (2013.01); *G03G 9/09725* (2013.01); *G03G 15/0865* (2013.01)

(58) Field of Classification Search

CPC ..... G03G 9/09725; G03G 9/09321; G03G 9/0371

USPC ..... 430/110.2, 108.7

See application file for complete search history.

(56) References Cited

U.S. PATENT DOCUMENTS

| | | | | |
|---|---|---|---|---|
| 4,533,617 | A * | 8/1985 | Inoue et al. | 430/110.2 |
| 6,015,656 | A * | 1/2000 | Nagami | 430/531 |
| 2006/0204882 | A1* | 9/2006 | Nozaki et al. | 430/110.2 |
| 2011/0318581 | A1* | 12/2011 | Zenitani et al. | 428/402 |
| 2013/0012657 | A1* | 1/2013 | Yoshikawa et al. | 428/402 |
| 2014/0170550 | A1* | 6/2014 | Kadokura et al. | 430/108.7 |

FOREIGN PATENT DOCUMENTS

| | | | |
|---|---|---|---|
| JP | 05119515 | A * | 5/1993 |
| JP | 2006-178093 | A | 7/2006 |
| JP | A-2011-145321 | | 7/2011 |
| JP | 2012-101953 | A | 5/2012 |

OTHER PUBLICATIONS

English language machine translation of JP 05-119515 (May 1993).*
English language machine translation of JPO Application 2012-274788 (retrieved from JPO Nov. 20, 2014).*
Jul. 28, 2015 Office Action issued in Japanese Application No. 2013-065023.

* cited by examiner

*Primary Examiner* — Christopher Rodee
(74) *Attorney, Agent, or Firm* — Oliff PLC

(57) ABSTRACT

An electrostatic charge image developing toner includes a toner particle including a core particle containing a polyester resin and a coating layer containing a vinyl resin that coats the surface of the core particle, and an external additive that is formed of silica particles having an average circularity of from 0.75 to 0.9 and an average value of ratios of circle equivalent diameters Da obtained by a plane image analysis to the maximum height H obtained by a stereoscopic image analysis of more than 1.5 and less than 1.9.

13 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-065023 filed Mar. 26, 2013.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including a toner particle including a core particle containing a polyester resin and a coating layer containing a vinyl resin which coats the surface of the core particle; and an external additive that is formed of silica particles having an average circularity of from 0.75 to 0.9 and an average value of ratios of "the circle equivalent diameters Da obtained by a plane image analysis" to "the maximum height H obtained by a stereoscopic image analysis" of more than 1.5 and less than 1.9.

BRIEF DESCRIPTION OF THE DRAWINGS

Exemplary embodiments of the present invention will be described in detail based on the following figures, wherein.

DETAILED DESCRIPTION

Electrostatic Charge Image Developing Toner

Figure 1:
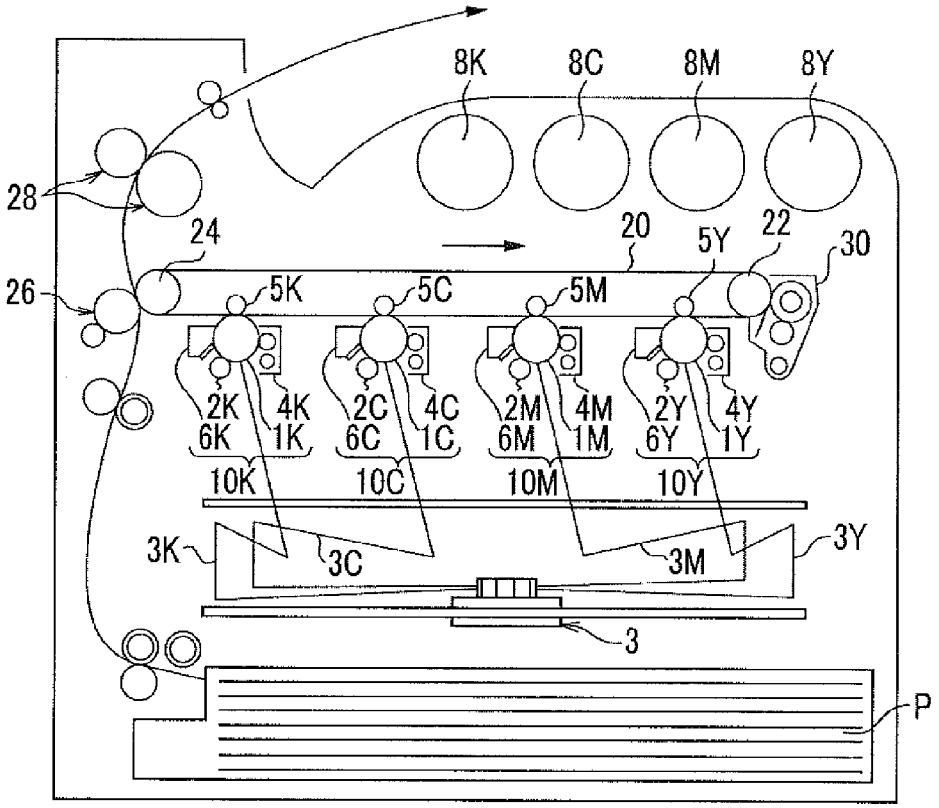
FIG. 1 shows a schematic configuration diagram of an example of an image forming apparatus according to an exemplary embodiment.

An electrostatic charge image developing toner (hereinafter, simply referred to as "toner" in some cases) according to the exemplary embodiment includes toner particles and an external additive. Accordingly, the toner particles refer to toner particles before the external additive is externally added. The toner particle is a toner particle including a core particle containing a polyester resin and a coating layer containing a vinyl resin which coats the surface of the core particle. The external additive includes silica particles having an average circularity of from 0.75 to 0.9 and an average value of ratios of circle equivalent diameters Da obtained by a plane image analysis to the maximum height H obtained by the stereoscopic image analysis of more than 1.5 and less than 1.9. In addition, the core particle refers to a portion not including the coating layer in the toner particle.

In the related art, while a toner which is fixed at a low temperature is realized by decreasing a glass transition temperature or a weight average molecular weight in a binder resin in toner particles, the toner having such a binder resin tends to be easily deteriorated in heat resistant storage properties and strength of a fixed image to be formed.

Here, a method of obtaining a toner having good low-temperature fixing properties and heat resistant storage properties by selecting a polyester resin as the binder resin has been known.

However, the polyester resin tends to easily adsorb moisture. When an image is formed in a state where moisture is contained in the toner (toner particles), the moisture is vaporized by heating during fixation to cause foaming in the image, and thus, image roughness occurs easily.

Then, the toner particles in the toner according to the exemplary embodiment employ toner particles in which the surface of the core particle, that is a particle containing a polyester resin, is coated by a coating layer containing a vinyl resin.

By employing the toner particles having such a configuration, the toner particles are coated by the coating layer containing a vinyl resin onto which the moisture is not easily adsorbed and the polyester resin is not easily exposed to the surface. Therefore, it is considered that the moisture is not easily adsorbed onto the toner. A higher ratio of the coating layer present on the surface of toner particle is preferable. However, it is considered that a ratio of 90% or more means that the surfaces of the toner particles are coated by the coating layer.

Further, the toner according to the exemplary embodiment is a toner to which an external additive which is formed of silica particles having an average circularity of from 0.75 to 0.9 and an average value of ratios of circle equivalent diameters Da obtained by a plane image analysis to the maximum height H obtained by the stereoscopic image analysis of more than 1.5 and less than 1.9, that is, an external additive which is formed of irregular-shaped silica particles having a large particle size and a plate-like flake structure.

Since only a specific surface of the external additive is wide due to the flake structure, and an area on the toner particles that one external additive coats is increased by bringing the wide surface into contact with the toner particles, it is considered that a coverage ratio of the toner particle is increased. Therefore, it is considered that the external additive coats the exposed portion of the toner particle on the surface of the toner to prevent the toner particles from being brought into contact with the moisture in a wide range.

In addition, for example, even when the external additive receives an external force by agitation in a developing unit, it is considered that the external additive does not easily roll on the toner particles due to the flake structure. Therefore, for example, even when an external force is applied, it is considered that a phenomenon that the external additive is separated from the toner to expose the toner particles does not easily occur.

That is, since the surfaces of the toner particles become more difficult to be exposed in the toner according to the exemplary embodiment by externally adding the external additive, it is considered that the moisture becomes more difficult to be adsorbed onto the toner.

Accordingly, in the case where the toner particles of the toner according to the exemplary embodiment employ the toner particles having the above-described configuration, since the image is prevented from being formed in a state where excess moisture is contained in the toner (toner particles) by externally adding the external additive having the above-described configuration, it is considered that foaming caused by heating during fixation is prevented and image roughness is prevented.

As a result of preventing adsorption of the polyester resin in the toner particle and moisture, in the toner according to the exemplary embodiment, it is considered that a decrease of the amount of the toner charged is prevented in a high humidity environment.

In addition, in the case where the toner particle using the polyester resin is produced in a wet production method, since the ester group of the polyester resin is easily moved to an interface with water during the granulation of the core particles, it is considered that the core particles tend to be particles in which the polyester resin is exposed on the surface.

On the other hand, in the toner according to the exemplary embodiment, even in the case the core particles are produced in a wet production method, since moisture is not easily adsorbed onto the toner as described above, image roughness caused by foaming formed in the fixed image during fixation is prevented.

Hereinafter, the configuration of the toner according to the exemplary embodiment will be described in detail.

External Additive

The external additive included in the toner according to the exemplary embodiment is formed of silica particles having an average circularity of from 0.75 to 0.9 and an average value of ratios of circle equivalent diameters Da obtained by a plane image analysis to the maximum height H obtained by the stereoscopic image analysis of more than 1.5 and less than 1.9.

Hereinafter, the silica particles as the external additive will be described.

Average Circularity

The silica particles have an average circularity of from 0.75 to 0.9.

By setting the average circularity to a range from 0.75 to 0.9, for example, the movement into concave portions on the surfaces of the toner particles in the case where the external additive receives an external force by agitation in a developing unit is prevented and the external additive is prevented from being unevenly distributed and further, moisture is prevented from being adsorbed onto the polyester resin in toner particles exposed on the surfaces of the toner particles, resulting in preventing of image roughness caused by foaming formed in the fixed image during fixation.

When the average circularity is 0.9 or less, the shape of the silica particle is far from a spherical shape, and thus, it is considered that the external additive is prevented from rolling and moving into the concave portions.

Moreover, when the average circularity is 0.75 or more, it is considered that the external additive is not easily destroyed in the case where a strong external force is applied.

The average circularity of the silica particles is more preferably from 0.8 to 0.9.

The circularity degree of silica particles is obtained as "100/SF2" which is calculated according to the following Equation (1) by observing the silica particles after externally adding the silica particles into the toner particles using a scanning electron microscope (SEM) apparatus and then performing a plane image analysis on the obtained silica particles.

$$\text{Circularity degree}(100/SF2)=4\pi\times(A/I^2) \qquad \text{Equation (1)}$$

In the equation (1), I represents a circumferential length of the silica particles on the image, and A represents a projected area of the silica particles.

The average circularity of the silica particles is obtained as a 50% circularity degree in a cumulative frequency of circularity degrees of 100 silica particles obtained by the plane image analysis.

Average Value of Ratios (Da/H) of Circle Equivalent Diameters Da Obtained by Plane image Analysis to Maximum Height H Obtained by Stereoscopic Image Analysis The average value of the ratios (Da/H) of "the circle equivalent diameters Da of the silica particles obtained by the plane image analysis" to "the maximum heights H of the silica particles obtained by the stereoscopic image analysis" is more than 1.5 and is less than 1.9.

The average value of Da/H is an average value of Da/H of the respective silica particles obtained by measuring Da and H with respect to the respective silica particles.

Since the shape of the silica particle employs a plate-like flake structure due to the average value of Da/H being more than 1.5 and less than 1.9, it is considered that the silica particles are prevented from moving to the concave portions on the surfaces of the toner particles.

Since the average value of Da/H is more than 1.5, the shape of the silica particle is close to the plate-like flake structure. In addition, since the average value of Da/H is more than 1.5, it is considered that the silica particles do not easily receive a mechanical load from outside due to an increase of the height H.

Furthermore, since the average value of Da/H is less than 1.9, the shape of the silica particle is prevented from being close to a flake shape, and thus, it is considered that the silica particles are not easily damaged when a mechanical load is applied to the silica particles.

The average value of Da/H is preferably from 1.6 to 1.85 and more preferably from 1.65 to 1.8.

The maximum heights H and the circle equivalent diameters Da of the silica particles are calculated in the following order.

With respect to the silica particles which are externally added to the toner particles, a height analysis in the X-Y axial direction is performed for each 10 nm in a field of view of a magnification of 10,000 times using an electron beam 3D roughness analysis device (ERA-8900, manufactured by Elionix Inc.), and the height is calculated and a 2D image of a magnification of 10,000 times in the same field of view is photographed at the same time.

Next, with respect to the 2D image, the circle equivalent diameter Da is calculated according to the following Equation (2) from the area calculated under the condition of 0.010000 μm/pixel using an image analysis software WinROOF (manufactured by Mitani Corporation), and a particle number is assigned to each particle.

$$\text{Circle equivalent diameter}=2\sqrt{(\text{area}/\pi)} \qquad \text{Equation (2)}$$

Further, by imaging the height analysis numerical values by a conditional format (bicolor scale) using Microsoft Excel spreadsheet software (developed by Microsoft Corporation), matching with the particle number for each particle is achieved and the maximum height H for each particle number in the individual particle is calculated.

In addition, the average value of Da/H is an average of 100 measured silica particles.

For example, the amount of the silica particles externally added is preferably from 0.1 part by weight to 3.0 parts by weight, more preferably from 0.3 part by weight to 2.0 parts by weight, and even more preferably from 0.5 part by weight to 1.8 parts by weight with respect to 100 parts by weight of the toner particles.

Volume Average Particle Size

The silica particles preferably have a volume average particle size in a normal range used as an external additive of a toner. For example, the volume average particle size is preferably from 70 nm to 200 nm.

By setting the volume average particle size of the silica particles to 70 nm or more, it is considered that the silica particles are prevented from being embedded in the toner particles and moisture is prevented from being attached to the toner due to the exposure of the toner particles on the surface of the toner.

By setting the volume average particle size of the silica particles to 200 nm or less, it is considered that the detachment of the silica particles from the toner is prevented and moisture is prevented from being adsorbed onto the toner due to the exposure of the toner particles on the surface of the toner.

The volume average particle size of the silica particles is more preferably from 80 nm to 150 nm.

The volume average particle size of the silica particles is an average circle equivalent diameter which is a 50% diameter (D50v) in a cumulative frequency of circle equivalent diameters obtained by observing 100 primary particles after dispersing the silica particles into the resin particles having a particle size of 100 μm (polyester, weight average molecular weight Mw=50,000) using a scanning electron microscope (SEM) and then performing an image analysis of the primary particles.

Component and Surface Treatment

The silica particles may be particles including silica, that is, $SiO_2$ as a main component, which may be crystalline or amorphous. Further, the silica particles may be particles produced by using silicon compounds such as water glass, alkoxysilanes as raw materials, or may be particles obtained by pulverizing quartz.

Further, from the viewpoint of the dispersibility of the silica particles, it is preferable that the surfaces of the silica particles be treated with a hydrophobizing agent (a hydrophobization treatment). For example, by coating the surfaces of the silica particles by alkyl groups, the silica particles are hydrophobized. To that end, for example, a known organic silicon compound having the alkyl group may act on the silica particles. Details about the method of hydrophobization treatment will be described later.

Method of Producing Silica Particles

The method of producing silica particles is not particularly limited, as long as obtained silica particles have the average circularity of from 0.75 to 0.9, and the average value of the ratios of the circle equivalent diameters Da obtained by the plane image analysis to the maximum heights H obtained by the stereoscopic image analysis of more than 1.5 and less than 1.9.

For example, the silica particles may be obtained by a dry method of pulverizing and classifying silica particles that have a particle size of more than 200 nm, or the silica particles may be produced by a so-called wet method of forming particles by a sol-gel method using a silicon compound represented as alkoxysilane as a raw material. As the wet method, there is also a method of obtaining silica sol using water glass as raw material, in addition to the sol-gel method.

In order to produce the silica particles satisfying the above-described average circularity and average value of Da/H, it is preferable to produce the silica particles using a sol-gel method, and it is preferable that the silica particles be sol-gel silica particles to which moisture is not easily attached, from the view point of preventing foaming formed in the fixed image during fixation.

As an example of the method of producing the silica particles, there may be the following method of producing sol-gel silica particles (hereinafter, referred to as "silica particles").

The method of producing the silica particles includes a process of preparing an alkali catalyst solution in which an alkali catalyst is included in a solvent which contains alcohol, a first supply process of supplying, until the amount of tetraalkoxysilane supplied reaches from 0.002 mol/mol to 0.008 mol/mol with respect to the amount of the alcohol in the preparation process, the tetraalkoxysilane and the alkali catalyst to the alkali catalyst solution, a supply stopping process of stopping the supply of the tetraalkoxysilane and the alkali catalyst for a period of time from 0.5 min to 10 min after the first supply process, and a second supply process of further supplying the tetraalkoxysilane and the alkali catalyst to the alkali catalyst solution after the supply stopping process.

That is, in the method of producing the silica particles according to the exemplary embodiment, the tetraalkoxysilane that is raw material and the alkali catalyst that is a catalyst are respectively and separately supplied in the presence of the alcohol including the alkali catalyst, the supply of both the tetraalkoxysilane and the alkali catalyst is stopped at least one time in the middle of the reaction of the tetraalkoxysilane, and then the supply of the tetraalkoxysilane and the alkali catalyst is restarted, to thereby form irregular-shaped flake silica particles.

In the method of producing the silica particles according to the exemplary embodiment, the irregular-shaped silica particles having the average value of Da/H of more than 1.5 and less than 1.9, and the average circularity of from 0.75 to 0.9 are obtained. Although not clear, the following may be considered as the reason.

Firstly, the alkali catalyst solution in which the alkali catalyst is included in the solvent which contains the alcohol is prepared. When the tetraalkoxysilane and the alkali catalyst are respectively supplied to the solution, the tetraalkoxysilane supplied to the alkali catalyst solution reacts to form nucleus particles. At this time, in addition to the catalyst action, the alkali catalyst is disposed on the surfaces of the formed nucleus particles to contribute to the shapes, dispersion stability and the like of the nucleus particles. However, since the alkali catalyst does not uniformly coat the surfaces of the nucleus particles (that is, since the alkali catalyst is unevenly attached to the surfaces of the nucleus particles), partial unevenness occurs in surface tension and chemical affinity of the nucleus particles while maintaining the dispersion stability of the nucleus particles, to thereby form the irregular-shaped nucleus particles.

Further, when the tetraalkoxysilane and the alkali catalyst are respectively supplied continuously, the formed nucleus particles are grown by the reaction of the tetraalkoxysilane.

At this time, when the amount of the tetraalkoxysilane supplied reaches the above-described specific concentration, the supply of the tetraalkoxysilane and the alkali catalyst is stopped for the above-described specific time, and then the supply is restarted.

By stopping the supply of the tetraalkoxysilane and the alkali catalyst, the particles in the reaction system are aggregated in a flake shape. Here, when the stop of the supply of the tetraalkoxysilane and the alkali catalyst is too early, that is, when the amount of the tetraalkoxysilane supplied is small, it is considered that the particle concentration in the reaction system is low and the probability of collision of the particles is low, and thus, it is difficult to proceed aggregation. On the other hand, when the time of stopping of the supply of the tetraalkoxysilane and the alkali catalyst is late and the amount of the tetraalkoxysilane supplied is large, it is considered that the nucleus particles are excessively grown, and the particles are stable and are not easily aggregated, and thus, the flake particles are not formed.

In addition, when the time of stopping the supply of the tetraalkoxysilane and the alkali catalyst is short, the amount of the particles aggregated is not sufficient, and when the stop time is long, the particles are excessively aggregated and tend to form a gel.

Further, by forming the irregular-shaped silica particles in a flake shape in the supply stopping process, and by restarting the supply of the tetraalkoxysilane and the alkali catalyst to promote the particle growth, it is considered that the silica particles having the flake shape in which the average value of Da/H is more than 1.5 and less than 1.9 and the irregular shape in which the average circularity of from 0.75 to 0.9 are obtained.

Also, in the method of producing the silica particles, since the irregular-shaped nucleus particles are formed and the nucleus particles are grown while maintaining the irregular shape to form the silica particles, it is considered that the irregular-shaped silica particles having high shape stability to a mechanical load are obtained.

Further, in the method of producing the silica particles, since the formed irregular-shaped nucleus particles are grown while maintaining the irregular shape to obtain the silica particles, it is considered that the silica particles, which are strong against a mechanical load and are hardly damaged, are obtained.

Furthermore, in the method of producing the silica particles, by respectively supplying the tetraalkoxysilane and the alkali catalyst to the alkali catalyst solution to cause the reaction of the tetraalkoxysilane, the particles are formed. Thus, compared with a case where the irregular-shaped silica particles are produced by the sol-gel method in the related art, the total amount of alkali catalysts used is reduced, and consequently, a removing process of the alkali catalyst is omitted. This is particularly effective in a case where the silica particles are applied to products that require high purity.

Hereinafter, the method of producing the silica particles will be described in detail.

The method of producing the silica particles is mainly divided into two processes. One is a process (preparation process) of preparing the alkali catalyst solution and the other is a process (particle formation process) of forming silica particles by supplying the tetraalkoxysilane and the alkali catalyst to the alkali catalyst solution.

The particle formation process is further divided into at least three steps, which includes the first supply process of supplying the tetraalkoxysilane and the alkali catalyst to the alkali catalyst solution to start formation of the silica particles, the supply stopping process of stopping the supply of the tetraalkoxysilane and the alkali catalyst (also referred to as a maturing process), and thereafter, the second supply process of restarting the supply of the tetraalkoxysilane and the alkali catalyst.

Preparation Process

In the preparation process, the solvent which contains the alcohol is prepared and the alkali catalyst is added thereto, to prepare the alkali catalyst solution.

The solvent which contains the alcohol may be a single alcohol solvent, or may be a mixed solvent with a different solvent such as water, ketones including acetone, methylethyl ketone, methylisobutyl ketone or the like, cellosolves such as methycellosolve, ethylcellosolve, butylcellosolve, cellosolve acetate or the like, or ethers such as dioxane, tetrahydrofuran or the like, as necessary. In the case of the mixed solvent, the amount of the alcohol in the other solvent is preferably 80% by weight or more (more preferably 90% by weight or more).

As the alcohol, for example, there may be lower alcohols such as methanol or ethanol.

On the other hand, the alkali catalyst is a catalyst for promoting the reaction (hydrolytic reaction, condensing reaction) of the tetraalkoxysilane. For example, a basic catalyst such as ammonia, urea, monoamine or quaternary ammonium salt may be used as the alkali catalyst, and particularly, ammonia is preferable.

The concentration (content) of the alkali catalyst is preferably from 0.62 mol/L to 0.7 mol/L and more preferably from 0.64 mol/L to 0.67 mol/L.

In the case where the concentration of the alkali catalyst falls in the above range, when the tetraalkoxysilane is supplied in the particle formation process, the dispersibility of the nucleus particles in the growth process of the formed nucleus particles is stabilized, and thus, it is possible to prevent formation of coarse aggregated substances such as secondary aggregated substances and to prevent gelation of the particles. Therefore, a preferable particle size is easily obtained.

The concentration of the alkali catalyst is a concentration in the alcohol catalyst solution (the alkali catalyst and the solvent including the alcohol).

Particle Formation Process

Next, the particle formation process will be described.

In the particle formation process, the tetraalkoxysilane and the alkali catalyst are respectively supplied to the alkali catalyst solution, and the tetraalkoxysilane reacts (hydrolytic reaction, condensing reaction) in the alkali catalyst solution, to thereby form the silica particles. In the method of producing the silica particles according to the exemplary embodiment, while the particles are growing in this manner, the supply of the added components is stopped to cause aggregation, to thereby form the irregular-shaped flake particles.

First Supply Process

The first supply process is a process of supplying the tetraalkoxysilane and the alkali catalyst to the alkali catalyst solution. The tetraalkoxysilane is supplied until the concentration becomes from 0.002 mol/mol to 0.008 mol/mol with respect to the amount of the alcohol in the preparation process.

Here, the "concentration of from 0.002 mol/mol to 0.008 mol/mol with respect to the amount of the alcohol in the preparation process" means from 0.002 mol to 0.008 mol with respect to a unit mol amount (1 mol) of the alcohol in the alkali catalyst solution prepared in the preparation process".

When the amount of the tetraalkoxysilane supplied in the first supply process is smaller than 0.002 mol/mol with respect to the amount of the alcohol in the alkali catalyst solution prepared in the preparation process, the particle concentration in the nucleus particle forming step becomes low, and thus, the coalescence of the particles is not performed, the particles having a low level of irregularity are formed, and the fluidity maintenance is deteriorated.

On the other hand, when the amount of the tetraalkoxysilane supplied is larger than 0.008 mol/mol with respect to the amount of the alcohol in the alkali catalyst solution prepared in the preparation process, the nucleus particles are stabilized, and thus, the coalescence of the particles is not performed, the particles having a low level of irregularity are formed, and the fluidity maintenance is deteriorated.

The amount of the tetraalkoxysilane supplied in the first supply process is preferably from 0.003 mol/mol to 0.008 mol/mol with respect to the amount of the alcohol in the alkali catalyst solution prepared in the preparation process, and more preferably from 0.006 mol/mol to 0.008 mol/mol.

As the tetraalkoxysilane supplied to the alkali catalyst solution, for example, a silane compound such as a tetrafunctional silane compound may be used.

Specifically, for example, tetramethoxysilane, tetraethoxysilane, tetrapropoxysilane, tetrabutoxysilane, or the like may be used, but from the viewpoint of controllability of reaction rate or shapes, particle sizes, particle size distributions and the like of the obtained silica particles, tetramethoxysilane or tetraethoxysilane is preferably used.

In the first supply process, the nucleus particles are formed by the reaction of the tetraalkoxysilane, in the early supply stage of the tetraalkoxysilane and the alkali catalyst (nucleus particle forming step), and then, the supply is further performed, to thereby grow the nucleus particles (nucleus particle growing step).

As described above, it is preferable that the alkali catalyst solution which is the target to which the tetraalkoxysilane and the alkali catalyst are supplied have the concentration (content) of the alkali catalyst of from 0.6 mol/L to 0.85 mol/L.

Accordingly, it is preferable that the first supply process include the nucleus particle forming process of supplying the tetraalkoxysilane and the alkali catalyst to the alkali catalyst solution in which the alkali catalyst is included with the concentration of from 0.6 mol/L to 0.85 mol/L to form the nucleus particles. The preferable range of the concentration of the alkali catalyst of the alkali catalyst solution is as described above.

The supply rate of the tetraalkoxysilane is preferably from 0.001 mol/(mol·min) to 0.010 mol/(mol·min) with respect to the alcohol in the alkali catalyst solution.

This means that the tetraalkoxysilane is supplied at the supply amount of from 0.001 mol to 0.010 mol per minute with respect to 1 mol of the alcohol used in the process of preparing the alkali catalyst solution.

By setting the supply rate of the tetraalkoxysilane in the above-described range, the irregular-shaped silica particles having the average circularity of from 0.75 to 0.9 are easily formed at high rates (for example, 95% or more in number).

The particle size of the silica particles depends on the kind or reaction condition of the tetraalkoxysilane, but, for example, by setting the total supply amount of the tetraalkoxysilane used in the reaction of the particle formation to 1.08 mol or more with respect to 1 L of a silica particle dispersion, the primary particles having a particle size of 70 nm or more are obtained, and by setting the total supply amount of the tetraalkoxysilane used in the reaction of the particle formation to 5.49 mol or less with respect to 1 L of the silica particle dispersion, the primary particles having a particle size of 200 nm or less are obtained.

When the supply rate of the tetraalkoxysilane is lower than 0.001 mol/(mol·min), it is considered that the tetraalkoxysilane may be supplied to the nucleus particles without unevenness before the reaction of the nucleus particles and the tetraalkoxysilane, and thus, the particle size and the shape show no unevenness, and the silica particles having a similar shape are formed.

When the supply rate of the tetraalkoxysilane is 0.010 mol/(mol·min) or less, the supply amount for the reaction of the tetraalkoxysilane in the nucleus particle forming step or the reaction of the tetraalkoxysilane and the nucleus particles in the particle growth do not become excessive, it is difficult for the reaction system to be gelated, and it is difficult to obstruct the formation of the nucleus particles and the particle growth.

The supply rate of the tetraalkoxysilane is preferably from 0.0065 mol/(mol·min) to 0.0085 mol/(mol·min) and more preferably from 0.007 mol/(mol·min) to 0.008 mmol/(mol·min).

On the other hand, as the alkali catalyst supplied to the alkali catalyst solution, for example, the above-described catalysts may be used. The alkali catalyst to be supplied may be the same kind as the alkali catalyst which is included in the alkali catalyst solution in advance or may be a different kind. However, the same kind is preferable.

The amount of the alkali catalyst supplied is preferably from 0.1 mol to 0.4 mol per 1 mol of the total amount of the tetraalkoxysilane supplied per minute, more preferably from 0.14 mol to 0.35 mol, and even more preferably from 0.18 mol to 0.30 mol.

By setting the amount of the alkali catalyst supplied to 0.1 mol or more, the dispersibility of the nucleus particles in the growth process of the formed nucleus particles becomes stable, and thus, coarse aggregated substances such as secondary aggregated substances are not easily formed, and the particles are prevented from being gelated.

On the other hand, by setting the amount of the alkali catalyst supplied to 0.4 mol or less, the stability of the formed nucleus particles do not easily become excessive, and thus, the irregular-shaped nucleus particles formed in the nucleus particle forming step are prevented from being grown in a spherical shape in the nucleus particle growing step.

Supply Stopping Process (Maturing Process)

In the supply stopping process, after the tetraalkoxysilane and the alkali catalyst are supplied by the first supply process until the tetraalkoxysilane has the above-described concentration, the supply of the tetraalkoxysilane and the alkali catalyst is stopped for a period of time of from 0.5 min to 10 min.

The supply stopping process is a so-called maturing process of once stopping the supply of the tetraalkoxysilane and the alkali catalyst and promoting the aggregation of the nucleus particles for maturing.

In a case where the supply stopping time of the tetraalkoxysilane and the alkali catalyst in the maturing process is 0.5 min or more, the coalescence of the particles is sufficiently performed, and thus, the particles having a high level of irregularity are formed.

In a case where the supply stopping time of the tetraalkoxysilane and the alkali catalyst in the maturing process is 10 min or less, the coalescence of the particles is prevented from being excessively performed, and thus, the dispersibility of the particles is prevented from being damaged.

The supply stopping time of the tetraalkoxysilane and the alkali catalyst in the maturing process is preferably from 0.6 min to 5 min, and more preferably from 0.8 min to 3 min.

Second Supply Process

In the second supply process, the tetraalkoxysilane and the alkali catalyst are further supplied after the supply stopping process. The supply of the tetraalkoxysilane and the alkali catalyst which are stopped by the supply stopping process is restarted, to grow the aggregate of the nucleus particles, thereby further increasing the volume average particle size of the flake irregular-shaped silica particles.

In the second supply process, preferable ranges of the concentration and the amount of the tetraalkoxysilane and the concentration and the amount of the alkali catalyst supplied to the reaction system are the same as in the first supply process.

In the second supply process, the concentration and the amount of the tetraalkoxysilane and the concentration and the amount of the alkali catalyst supplied to the reaction system may be different from the concentration and the amount of the tetraalkoxysilane and the concentration and the amount of the alkali catalyst supplied to the reaction system in the first supply process.

In the particle formation process (including the first supply process, the maturing process and the second supply process), for example, the temperature of the alkali catalyst solution (temperature at the time of supply) is preferably from 5° C. to 50° C. and more preferably in the range of from 15° C. to 40° C.

In addition, the method of producing the silica particles according to the exemplary embodiment may have one or more supply stopping processes after the second supply process or may have a supply process of further supplying the tetraalkoxysilane and the alkali catalyst.

The silica particles are obtained from the above-described processes. In this state, the obtained silica particles are obtained in the state of dispersion, but may be used as the silica particle dispersion as it is, or may be extracted to be used as powder of the silica particles by removing the solvent.

When the silica particles are used as the silica particle dispersion, the silica particle solid content concentration may be adjusted by diluting with water or alcohol or concentrating the silica particle dispersion as necessary. Further, the silica particle dispersion may be subjected to solvent replacement by a water soluble organic solvent such as alcohols, esters, or ketones.

On the other hand, when the silica particles are used as the silica particle powder, it is necessary to remove the solvent from the silica particle dispersion, and as a method of removing the solvent, known methods such as 1) a method of removing the solvent by filtering, centrifugal separation, distillation or the like and then drying the silica particles using a vacuum dryer, a shelf stage dryer or the like, or 2) a method of directly drying slurry using a fluidized-bed dryer, a spray dryer or the like, are used, for example. The drying temperature is not particularly limited, but preferably 200° C. or lower. When the temperature is higher than 200° C., binding of primary particles or formation of coarse particles easily occur due to condensation of a silanol group which remains on the surfaces of the silica particles.

In the dried silica particles, it is preferable that coarse particles or aggregated substances be removed by pulverizing or sieving as necessary. The pulverization method is not particularly limited, but for example, is performed by a dry type pulverizing device such as a jet mill, a vibration mill, a ball mill or a pin mill. The sieving method is performed by known devices such as a vibration sieve or a wind classifier, for example.

The silica particles obtained by the method of producing the silica particles may be used after performing a hydrophobization treatment on the surfaces of the silica particles with a hydrophobizing agent.

As the hydrophobizing agent, for example, known organic silicon compounds having, for example, an alkyl group (for example, methyl group, ethyl group, propyl group, butyl group or the like) is used. Specific examples thereof include a silazane compound (for example, a silane compound such as methyltrimethoxysilane, dimethyldimethoxysilane, trimethylchlorosilane or trimethylmethoxysilane, hexamethyldisilazane, tetramethyldisilazane, or the like) and the like. The hydrophobizing agent used may be a single kind or plural kinds.

Among the hydrophobizing agents, the organic silicon compound having a trimethyl group such as trimethylmethoxysilane or hexamethyldisilazane is preferably used.

The amount of the hydrophobizing agent used is not particularly limited, but the amount thereof is preferably from 1% by weight to 100% by weight and more preferably from 5% by weight to 80% by weight with respect to the silica particles, for example, to obtain the hydrophobization effect.

As a method of obtaining the hydrophobic silica particle dispersion to which the hydrophobization treatment is performed by the hydrophobizing agent, for example, there is a method of adding the hydrophobizing agent of a necessary amount to the silica particle dispersion and reacting the mixture in a temperature range of from 30° C. to 80° C. while being stirred, to perform the hydrophobization treatment on the silica particles and to obtain the hydrophobic silica particle dispersion. When the reaction temperature is lower than 30° C., the hydrophobization reaction is hardly promoted, and when the reaction temperature is higher than 80° C., gelation of the dispersion, aggregation of the silica particles or the like may easily occur due to self condensation of the hydrophobizing agent.

On the other hand, as a method of obtaining the hydrophobic silica particles of the powder, there is a method of obtaining a hydrophobic silica particle dispersion by the above-described method and then drying the dispersion to obtain the powder of the hydrophobized silica particles by the above-described method, a method of drying a silica particle dispersion to obtain the powder of hydrophilic silica particles and then adding a hydrophobizing agent thereto to perform a hydrophobization treatment and to obtain the powder of the hydrophobic silica particles, a method of obtaining a hydrophobic silica particle dispersion, drying the dispersion to obtain the powder of hydrophobic silica particles, and then adding a hydrophobizing agent thereto to perform a hydrophobization treatment and to obtain the powder of hydrophobized silica particles, or the like.

Here, as a method of hydrophobizing the silica particles of the powder, there is a method of stirring hydrophilic silica particles of powder in a treatment tank such as a Henschel mixer or fluid bed, adding a hydrophobizing agent thereto, and heating the inside of the treatment tank, to thereby gasify the hydrophobizing agent to react with the silanol group of the surfaces of the silica particles of the powder, for example. The processing temperature is not particularly limited. However, for example, the temperature is preferably from 80° C. to 300° C. and more preferably from 120° C. to 200° C.

The aforementioned hydrophobization treatment may be a treatment to hydrophobize the surfaces of the silica particles by a hydrophobizing agent in supercritical carbon dioxide.

Here, the hydrophobization treatment may be performed in supercritical carbon dioxide (that is, under the supercritical carbon dioxide atmosphere). Specifically, the hydrophobization treatment may be performed while the supercritical carbon dioxide is circulated (that is, the supercritical carbon dioxide is introduced and discharged into the treatment tank), and the hydrophobization treatment may be performed while the supercritical carbon dioxide is not circulated.

Toner Particle

The toner particle includes a core particle containing a polyester resin and a coating layer containing a vinyl resin which coats the surface of the core particle.

Core Particle

The core particle contains a polyester resin, and a colorant, a release agent and other components as necessary. In addition, the core particle may contain resins other than the polyester resin.

Polyester Resin

The polyester resin is used as a binder resin.

Examples of the polyester resin include known polyester resins.

As the polyester resin, for example, there is a condensation polymer of a polyvalent carboxylic acid and a polyol. In addition, as the polyester resin, commercially available products may be used, or synthetic resins may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkyenyl succinic acid, adipic acid and sebacic acid), alicyclic dicarboxylic acids (for example, cyclohexane dicarboxylic acid), aromatic dicarboxylic acids (for example, terephthalic acid, isophthalic acid, phthalic acid, and naphthalene dicarboxylic acid) and anhydrides and lower alkyl esters (for example, a carbon number of from 1 to 5) thereof. Among these polyvalent carboxylic acids, for example, aromatic carboxylic acids are preferably used.

As the polyvalent carboxylic acids, a trivalent or higher valent carboxylic acid which has a crosslinked structure or a branched structure may be used with dicarboxylic acids. Examples of the trivalent or higher valent carboxylic acid include trimellitic acid, pyromellitic acid, and anhydrides and lower alkyl esters (for example, having a carbon number of from 1 to 5) thereof.

These polyvalent carboxylic acids may be used singly or in combination of two or more kinds.

Examples of the polyol include aliphatic dials (for example, ethylene glycol, diethylene glycol, triethylene glycol, propylene glycol, butanediol, hexanediol, and neopentyl glycol), alicyclic diols (for example, cyclohexanediol, cyclohexanedimethanol and hydrogen-added bisphenol A), and aromatic diols (for example, ethylene oxide adducts of bisphenol A and propylene oxide adducts of bisphenol A). Among these polyols, aromatic dials and alicyclic dials are preferably used, and aromatic dials are more preferably used.

As the polyols, a trivalent or higher valent polyol which has a crosslinked structure or a branched structure may be used with dials. Examples of the trivalent or higher valent polyol include glycerin, trimethylolpropane, and pentaerythritol.

These polyols may be used singly or in combination of two or more kinds.

The glass transition temperature (Tg) of the polyester resin is preferably from 50° C. to 80° C., and more preferably from 50° C. to 65° C.

In addition, the glass transition temperature is calculated from a DSC curve obtained from differential scanning calorimetry (DSC) and more specifically, the glass transition temperature is calculated according to "extrapolated glass transition starting temperature" described in a method of calculating glass transition temperature in "Testing methods for transition temperatures of plastics" of JIS K-1987.

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and number average molecular weight are measured by gel permeation chromatography (GPC). The GPC molecular weight measurement is performed using GPC HLC-8120 (manufactured by Tosoh Corporation) as a measurement device and TSK gel Super HM-M (15 cm) (manufactured by Tosoh Corporation) as a column with THF as a solvent. The weight average molecular weight and number average molecular weight are calculated using a molecular weight calibration curve prepared using a monodispersed polystyrene standard sample from the measurement result.

The polyester resin can be produced using a known production method. Specifically, for example, there may be a method of preparing a polyester resin at a polymerization temperature in a range from 180° C. to 230° C. by reducing the pressure in the reaction system, as necessary, and reacting raw materials while removing water and alcohol generated during condensation.

In addition, when raw material monomers are not dissolved or compatible with each other at the reaction temperature, a solvent having a high boiling point may be added thereto as a dissolution aid, in order to dissolve the monomers. In this case, the polycondensation reaction is performed while distilling the dissolution aid. When a monomer having a poor compatibility is present in the copolymerization reaction, the polycondensation reaction may be performed with the main component by previously condensing the monomer having a poor compatibility with the acid or alcohol to be polycondensed with the monomer.

The content of the polyester resin is preferably from 40% by weight to 95% by weight, more preferably from 50% by weight to 90% by weight, even more preferably from 60% by weight to 85% by weight with respect to the total amount of the toner particles.

Colorant

Examples of the colorants include various kinds of pigments such as carbon black, chrome yellow, Hansa Yellow, Benzidine Yellow, Indanthrene Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Chalco Oil Blue, Methylene Blue Chloride, Phthalocyanine Blue, Pigment Blue, Phthalocyanine Green and Malachite Green Oxalate, and various kinds of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds.

Regarding the colorant, as necessary, a surface-treated colorant may be used and a dispersant may be used in combination. In addition, plural kinds of colorants may be used in combination.

For example, the content of the colorant is preferably, for example, from 1% by weight to 30% by weight and more preferably from 3% by weight to 15% by weight with respect to the total amount of the toner particles.

Release Agent

Examples of the release agent include hydrocarbon wax; natural wax such as carnauba wax, rice wax and candelilla wax; synthetic or mineral and petroleum wax such as montan wax; and ester wax such as fatty acid ester and montanic acid ester. However, the release agent is not limited thereto.

The melting temperature of the release agent is preferably from 50° C. to 110° C. and more preferably from 60° C. to 100° C.

In addition, the melting temperature is calculated from the DSC curve obtained from differential scanning calorimetry (DSC) according to a "melting peak temperature" described in a method of calculating melting temperature in "Testing methods for transition temperatures of plastics" of JIS K-1987.

The content of the release agent is preferably, for example, from 1% by weight to 20% by weight and more preferably from 5% by weight to 15% by weight with respect to the total amount of the toner particles.

Other Additives

Examples of the other additives include well-known additives such as a magnetic material, a charge-controlling agent, and an inorganic powder. These additives are contained in the toner particles as an internal additive.

Resins Other than Polyester Resin

Examples of resins other than the polyester resin include vinyl resins made of homopolymers of monomers such as styrenes (for example, styrene, parachlorostyrene and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate), ethylenic unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone and vinyl isopropenyl ketone), and olefins (for example, ethylene, propylene and butadiene), and copolymers of two kinds or more of these monomers combined.

In addition, examples of the resins include non-vinyl resins such as epoxy resins, polyurethane resins, polyamide resins, cellulose resins, polyether resins, modified rosins, mixtures of the non-vinyl resins with the above vinyl resins, and graft copolymers obtained by polymerizing the above vinyl monomers under a coexistence of the above non-vinyl resins.

These binder resins may be used singly or in combination of two or more kinds.

Coating Layer

The coating layer of the toner particle is a layer including a vinyl resin.

Examples of the vinyl resin include homopolymers of monomers such as styrenes such as styrene, parachlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; and monomers that are raw materials of vinyl polymer acids and vinyl polymer bases such as acrylic acid, methacrylic acid, maleic acid, cinnamic acid, fumaric acid, vinyl sulfonic acid, ethylenimine, vinylpyridine and vinylamine, and copolymers thereof.

Among them, a copolymer of styrene and at least one selected from methyl acrylate, ethyl acrylate, butyl acrylate and 2-ethylhexyl acrylate is preferably used and a copolymer of styrene and butyl acrylate is more preferable.

The weight average molecular weight (Mw) of the vinyl resin is preferably from 5,000 to 100,000 and more preferably from 10,000 to 50,000.

A method of measuring the weight average molecular weight of the vinyl resin is the same as the aforementioned method of measuring the weight average molecular weight of the polyester resin.

As other additives which may be contained in the coating layer, for example, there are resin particles having high hydrophobicity such as fluorine-containing resin particles and silicone resin particles or hydrophobic silica and hydrophobic titania.

Production of Toner Particles

As a method of producing the toner particles, for example, after a core particle is produced, a coating layer is formed on the surface of the core particle using a coating layer forming material containing a vinyl resin.

First, the method of producing the core particle will be described.

Production of Core Particles

The core particles may be produced by any of a dry production method (for example, a kneading and pulverization method) and a wet production method (for example, an aggregation and coalescence method, suspension polymerization method and a dissolution suspension method). The method of preparing the core particles is not particularly limited thereto and a known method is employed.

Among them, the core particles are preferably prepared by an aggregation and coalescence method.

Specifically, for example, when the core particles are produced using the aggregation and coalescence method, the core particles are produced through a process of preparing a resin particle dispersion in which polyester resin particles (hereinafter, simply referred to as "resin particles") which become a binder resin are dispersed (resin particle dispersion preparation process), a process of forming aggregated particles by aggregating the resin particles (as necessary, other particles) in the resin particle dispersion (as necessary, in the dispersion after other particle dispersions are mixed) (aggregated particle forming process), and a process of forming core particles by heating an aggregated particle dispersion in which the aggregated particles are dispersed to coalesce the aggregated particles (coalescing process).

Hereinafter, each process will be described in detail.

While a method of obtaining toner particles containing a colorant and a release agent will be described in the following description, the colorant and the release agent are used as necessary. Any additive other than colorants and release agents may, of course, be used.

Resin Particle Dispersion Preparation Process

First, along with a resin particle dispersion in which resin particles which are a binder resin are dispersed, for example, a colorant particle dispersion in which colorant particles are dispersed, and a release agent dispersion in which release agent particles are dispersed are prepared.

Herein, the resin particle dispersion is prepared, for example, by dispersing the resin particles in a dispersion medium by aid of a surfactant.

An example of the dispersion medium used in the resin particle dispersion includes an aqueous medium.

Examples of the aqueous medium include water such as distilled water and ion exchange water, and alcohols and the like. These may be used singly or in combination of two or more kinds.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more kinds.

In the resin particle dispersions, the resin particles may be dispersed in the dispersion medium by a general dispersion method, for example, by using a rotary shear type homogenizer, or a ball mill, as sand mill or a dynomill having media. Further, depending on the kind of resin particles, the resin particles may be dispersed in the resin particle dispersion, for example, by phase inversion emulsification.

The phase inversion emulsification is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase from W/O to O/W (so-called phase inversion), so that the resin may be dispersed in the form of particles in the aqueous medium.

The volume average particle size of the resin particles dispersed in the resin particle dispersions is preferably, for example, from 0.01 μm to 1 μm, more preferably from 0.08 μm to 0.8 μm, and even more preferably from 0.1 μm to 0.6 μm.

In addition, the volume average particle size of the resin particles is measured such that using the particle size distribution measured by a laser diffraction particle size distribution analyzer (LA-700, manufactured by Horiba Seisakusho Co., Ltd.), a cumulative distribution is drawn from the small diameter side with respect to the volume based on the divided particle size ranges (channels) and the particle size at which the cumulative volume distribution reaches 50% of the total particle volume is defined as a volume average particle diameter D50v. Hereinafter, the volume average particle size of particles in the other dispersion will be measured in the same manner.

For example, the content of the resin particles contained in the resin particle dispersion is preferably from 5% by weight to 50% by weight and more preferably from 10% by weight to 40% by weight.

For example, the colorant dispersion and the release agent dispersion may be prepared in a manner similar to the dispersion of resin particles. That is, with respect to the volume average particle diameter of the particles, the dispersion medium, the dispersion method and the content of the particles in the dispersion of the resin particles, the same is applied to the colorant particles dispersed in the colorant dispersion and the release agent particles dispersed in the release agent dispersion.

Aggregated Particle Forming Process

Next, along with the resin particle dispersion, the colorant particle dispersion and the release agent dispersion are mixed.

Then, in the mixed dispersion, the resin particles, the colorant particles and the release agent particles are heteroaggregated to form aggregated particles containing the resin particles, the colorant particles and the release agent particles, which have an approximately targeted particle size of the core particle.

Specifically, for example, an aggregation agent is added to the mixed dispersion, and the pH of the mixed dispersion is adjusted to an acidic range (for example, from pH 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming process, for example, the aggregation agent is added to the mixed dispersion while stirring using a rotary shear type homogenizer at room temperature (for example, 25° C.), and the pH of the mixed dispersion is adjusted to an acidic range (for example, from pH 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. In particular, when a metal complex is used as an aggregation agent, the amount of the surfactant used is reduced, which results in improvement of charging properties.

An additive capable of forming a complex or a similar bond with a metal ion in the aggregation agent may be used as necessary. As the additive, a chelating agent is suitable.

Examples of the inorganic metal salt include metal salts such as calcium chloride, calcium nitrate, barium chloride, magnesium chloride, zinc chloride, aluminum chloride and aluminum sulfate, and polymers of inorganic metal salts such as polyaluminum chloride, polyaluminum hydroxide and calcium polysulfide.

The chelating agent may be a water soluble chelating agent. Examples of the chelating agent include oxycarboxylic acids such as tartaric acid, citric acid and gluconic acid, iminodiacetic acid (IDA), nitrilotriacetic acid (NTA), and ethylenediaminetetraacetic acid (EDTA).

The amount of the chelating agent added is preferably from 0.01 part by weight to 5.0 parts by weight and more preferably 0.1 part by weight or more and less than 3.0 parts by weight with respect to 100 parts by weight of the resin particles.

Coalescing Process

Next, the aggregated particles are coalesced by heating the aggregated particle dispersion having the aggregated particles dispersed therein to, for example, the glass transition temperature of the resin particles (for example, 10° C. to 30° C. higher than the glass transition temperature of the resin particles) or higher, to form core particles.

The core particles are obtained by the above-described processes.

Further, the core particles may be produced by a process of forming second aggregated particles by obtaining an aggregated particle dispersion having the aggregated particles dispersed therein, mixing the aggregated particle dispersion and the resin particle dispersion having the resin particles dispersed therein and further performing aggregation so as to attach the resin particles on the surface of the aggregated particles, and a process of coalescing the second aggregated particles by heating a second aggregated particle dispersion having the second aggregated particles dispersed therein to form core particles of a core and shell structure.

After the coalescing process is completed, the core particles formed in the solution are subjected to washing, solid-liquid separation and drying processes as known in the art to obtain dried core particles.

The washing process may be sufficiently performed by a replacement washing with ion exchange water in terms of charging properties. The solid-liquid separation process is not particularly limited but may be performed by filtration under suction or pressure in terms of productivity. The drying process is not particularly limited but may be performed by freeze-drying, flash jet drying, fluidized drying or vibration fluidized drying in terms of productivity.

Formation of Coating Layer

As a method of forming the coating layer on the surface of the core particle, for example, there is a dry application method.

As the dry application method, for example, there is a method of heating the dried mixture of the core particles and the aforementioned material for forming the coating layer to form the coating layer. Specifically, for example, the core particle and the aforementioned material for forming the coating layer are mixed in a gas phase, heated and fused without using a solvent to form the coating layer.

Further, apparatuses such as a jet mill, a hammer mill and a turbo mill are used for the mixing and an apparatus having a cooling function is preferably used.

The toner particles including the core particle containing a polyester resin and the coating layer containing a vinyl resin which coats the surface of the core particle are obtained by the above method.

The toner particle according to the exemplary embodiment may have a core-shell structure constituted by a core containing a polyester resin and a shell layer containing a vinyl resin by the production using the aggregation and coalescence method.

That is, the toner particle according to the exemplary embodiment may be a toner particle in which the core is the core particle containing a polyester resin and the shell layer is the coating layer containing a vinyl resin.

Properties of Toner Particles and the Like

The volume average particle size (D50v) of the toner particles is preferably from 2 μm to 10 μm and more preferably from 4 μm to 8 μm.

Various kinds of average particle sizes and particle size distribution indexes of the toner particles are measured using a COULTER MULTISIZER II (manufactured by Beckman Coulter, Inc.). ISOTON-II (manufactured by Beckman Coulter, Inc.) is used as an electrolyte.

In the measurement, 0.5 mg to 50 mg of a measurement sample is added to 2 ml of a 5% surfactant (sodium alkyl benzene sulfonate is preferable) aqueous solution as a dispersant. The mixture is added to 100 ml to 150 ml of the electrolyte.

The electrolyte in which the sample is suspended is subjected to a dispersion treatment for 1 minute using an ultrasonic dispersing machine, and a particle size distribution of particles of from 2 μm to 60 μm is measured with the COULTER MULTISIZER II by using an aperture having an aperture diameter of 100 μm. 50,000 particles are sampled.

A cumulative distribution is drawn from the smallest diameter side for the volume and the number with respect to particle size ranges (channels) divided on the basis of the particle size distributions measured in this manner. The particle sizes corresponding to 16% in the cumulative distributions are defined as a volume average particle size D16v and a number average particle size D16p, the particle sizes corresponding to 50% in the cumulative distributions are defined as a volume average particle size D50v and a number average particle size D50p, and the particle sizes corresponding to 84% in the cumulative distributions are defined as a volume average particle size D84v and a number average particle size D84p.

Using these particle sizes, a volume average particle size distribution index (GSDv) is calculated as $(D84v/D16v)^{1/2}$ and a number average particle size distribution index (GSDp) is calculated as $(D84p/D16p)^{1/2}$.

The shape factor SF1 of the toner particle is preferably from 110 to 150 and more preferably from 120 to 140.

Here, the shape factor SF1 is obtained by the following Equation.

$$SF1=(ML^2/A)\times(\pi/4)\times 100 \quad \text{Equation}$$

In the equation, ML represents an absolute maximum length of the toner particle, and A represents a projected area of the toner particle.

Specifically, the shape factor SF1 is calculated as follows mainly using a microscopic image or an image of a scanning electron microscope (SEM) image that is analyzed using an image analyzer to be digitized. That is, an optical microscopic image of particles sprayed on the surface of a glass slide is scanned to an image analyzer LUZEX through a video camera, the maximum lengths and the projected areas of 100 particles are obtained, calculation using the above-described equation is performed, and an average value thereof is obtained.

In the toner particle, the coverage rate of the coating layer with respect to the core particle is preferably from 70% by weight to 100% by weight, more preferably from 80% by weight to 100% by weight, and even more preferably from 85% by weight to 100% by weight.

A method of measuring the coverage rate is as follows.

The element analysis of the cross section of the toner is performed using a SEM-EDX to quantitate the amounts of the elements such as tin derived from a catalyst. Next, the element analysis is performed on the surface of the toner in the same manner to measure the ratio of the elements of the respective cross section and surface with respect to carbon. Far example, when the amount of tin of the cross section with respect to carbon is A and the amount of tin of the surface with respect to carbon is B, the percentage of B/A is the coverage rate.

Production of Toner

The toner according to the exemplary embodiment is produced, for example, by adding and mixing the obtained external additive to the obtained dried toner particles. The mixing may be preferably performed by a V blender, a Henschel mixer, a Lodige mixer and the like. Further, as necessary, coarse particles may be removed using a vibration sieve or a wind classifier.

For example, the amount of the external additive externally added is preferably from 0.01% by weight to 5% by weight and more preferably from 0.01% by weight to 2.0% by weight with respect to the toner particles.

Electrostatic Charge Image Developer

The electrostatic charge image developer according to the exemplary embodiment is a developer including at least the toner according to the exemplary embodiment.

The electrostatic charge image developer according to the exemplary embodiment may be a single-component developer containing only the toner according to the exemplary embodiment, or may be a two-component developer containing a mixture of the toner and a carrier.

There is no particular limitation to the carrier and known carriers may be used. Examples of the carrier include a coated carrier in which the surface of a core made of a magnetic powder is coated with coating resin; a magnetic powder dispersed carrier in which a magnetic powder is dispersed and blended in a matrix resin; a resin impregnated carrier in which a porous magnetic powder is impregnated with a resin; and a resin dispersed carrier in which conductive particles are dispersed and blended in a matrix resin.

The magnetic powder dispersed carrier, resin impregnated carrier and conductive particle dispersed carrier may be carriers each having the constitutional particle as a core and a coating resin coating the core.

Examples of the magnetic powder include magnetic metal such as iron oxide, nickel, or cobalt and a magnetic oxide such as ferrite and magnetite.

Examples of the conductive particles include metal particles of gold, silver and copper and the like, and particles of carbon black, titanium oxide, zinc oxide, tin oxide, barium sulfate, aluminum borate, potassium titanate or the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene acrylic acid copolymer, a straight silicone resin containing an organosiloxane bond or a modified article thereof, a fluoro resin, polyester, polycarbonate, a phenol resin, and an epoxy resin.

Further, the coating resin and matrix resin may contain conductive materials and other additives and the like.

Here, in order to coat the surface of the core with the coating resin, a coating method using a coating layer forming solution in which a coating resin and various kinds of additives are dissolved in an appropriate solvent as necessary, can be used. The solvent is not particularly limited and may be selected depending on a coating resin to be used and application suitability.

Specific examples of the resin coating method include an immersion method including immersing a core in a coating layer forming solution, a spray method including spraying a coating layer forming solution to the surface of a core, a fluidized-bed method including spraying a coating layer forming solution to a core while the core is suspended by a fluidizing air, and a kneader coater method including mixing a core of a carrier with a coating layer forming solution in a kneader coater, and then removing the solvent.

In the two-component developer, a mixing ratio (weight ratio) of the toner and the carrier is preferably toner:carrier=1:100 to 30:100, and more preferably 3:100 to 20:100.

Image Forming Apparatus and Image Forming Method

Next, an image forming apparatus and an image forming method according to the exemplary embodiment will be described.

The image forming apparatus according to the exemplary embodiment includes an image holding member; a charging unit that charges a surface of the image holding member; an electrostatic charge image forming unit that forms an electrostatic charge image on a charged surface of the image holding member; a developing unit that accommodates an electrostatic charge image developer, and develops the electrostatic charge image formed on the surface of the image holding member as a toner image with the electrostatic charge image developer; a transfer unit that transfers the toner image formed on the surface of the image holding member onto the surface of a recording medium; and a fixing unit that fixes the toner image transferred onto the surface of the recording medium. As the electrostatic charge image developer, the electrostatic charge image developer according to the exemplary embodiment is used.

In the image forming apparatus according to the exemplary embodiment, an image forming method (image forming method according to the exemplary embodiment) is carried out which includes charging a surface of an image holding member; forming an electrostatic charge image on a charged surface of the image holding member; developing the electrostatic charge image formed on the surface of the image holding member as a toner image with the electrostatic charge image developer according to the exemplary embodiment; transferring the toner image formed onto the surface of the image holding member onto the surface of a recording medium; and fixing the toner image transferred onto the surface of the recording medium.

As the image forming apparatus according to the exemplary embodiment, well-known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member before charged and after a toner image is transferred; and an image forming apparatus including an erasing unit which erases a charge from the surface of an image holding member before charged and after a toner image is transferred, by irradiating the surface with easing light may be used.

In the case of the intermediate transfer type image forming apparatus, for example, a transfer unit includes an intermediate transfer member in which a toner image is transferred onto the surface, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium.

In the image forming apparatus according to the exemplary embodiment, for example, a portion including the developing unit may have a cartridge structure (process cartridge) which is detachable from the image forming apparatus. As the process cartridge, for example, a process cartridge which accommodates the electrostatic charge image developer according to the exemplary embodiment and is provided with the developing unit is suitably used.

Hereinafter, an example of the image forming apparatus according to the exemplary embodiment will be shown. However, there is no limitation thereto. In addition, main components shown in the drawing will be described, and the descriptions of the other components will be omitted.

FIG. 1 shows a schematic configuration diagram of an image forming apparatus according to the exemplary embodiment.

The image forming apparatus shown in FIG. 1 includes first to fourth electrophotographic image forming units (image forming units) 10Y, 10M, 10C, and 10K which output images of the respective colors including yellow (Y), magenta (M), cyan (C), and black (K) on the basis of color-separated image data. These image forming units (hereinafter, also referred to simply as "units" in some cases) 10Y, 10M, 10C and 10K are arranged horizontally in a line with predetermined distances therebetween. Incidentally, each of these units 10Y, 10M, 10C and 10K may be a process cartridge which is detachable from the image forming apparatus.

An intermediate transfer belt 20 is provided through each unit as an intermediate transfer member extending above each of the units 10Y, 10M, 10C and 10K in the drawing. The intermediate transfer belt 20 is provided around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, the support roller 24 is pushed in a direction away from the drive roller 22 by a spring or the like (not shown), such that tension is applied to the intermediate transfer belt 20 which is provided around the support roller 24 and the drive roller 22. Also, on the surface of the image holding member side of the intermediate transfer belt 20, an intermediate transfer member cleaning device 30 is provided opposing the drive roller 22.

Also, toners in the four colors of yellow, magenta, cyan and black, which are accommodated in toner cartridges 8Y, 8M, 8C and 8K, respectively, are supplied to developing devices (developing units) 4Y, 4M, 4C and 4K of the above-described units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. In addition, the same components as those of the first unit 10Y are represented by reference numerals to which the symbols M (magenta), C (cyan), and K (black) are attached instead of the symbol Y (yellow), and the descriptions of the second to fourth units 10M, 10C, and 10K, will be omitted.

The first unit 10Y includes a photoreceptor 1Y functioning as the image holding member. In the surroundings of the photoreceptor 1Y, there are successively disposed a charging roller 2Y (an example of the charging unit) for charging the surface of the photoreceptor 1Y to a predetermined potential; an exposure device 3 (an example of the electrostatic charge image forming unit) for exposing the charged surface with a laser beam 3Y on the basis of a color-separated image signal to form an electrostatic charge image; the developing device 4Y (an example of the developing unit) for supplying a charged toner into the electrostatic charge image to develop the electrostatic charge image; a primary transfer roller 5Y (an example of the primary transfer unit) for transferring the developed toner image onto the intermediate transfer belt 20; and a photoreceptor cleaning device 6Y (an example of the cleaning unit) for removing the toner remaining on the surface of the photoreceptor 1Y after the primary transfer.

The primary transfer roller 5Y is disposed inside the intermediate transfer belt 20 and provided opposite to the photoreceptor 1Y. Furthermore, bias power supplies (not shown), which apply primary transfer biases, are respectively connected to the respective primary transfer rollers 5Y, 5M, 5C and 5K. A controller (not shown) controls the respective bias power supplies to change the primary transfer biases which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), but has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller (not shown). The photosensitive layer on the surface of the photoreceptor 1Y is irradiated with the laser beam 3Y. As a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is formed on the photoreceptor 1Y in this manner is rotated to a predetermined development position along with the travel of the photoreceptor 1Y. At this development position, the electrostatic charge image on the photoreceptor 1Y is visualized (developed) by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge charged on the photoreceptor 1Y and is maintained on a developer roller (an example of the developer holding member). When the surface of the photoreceptor 1Y passes through the developing device 4Y, the yellow toner is electrostatically attached to a latent image portion on the surface of the photoreceptor 1Y from which the charge is erased, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a (+) polarity opposite to the polarity (−) of the toner. For example, the first unit 10Y is controlled to +10 μA by the controller (not shown).

Meanwhile, the toner remaining on the photoreceptor 1Y is removed and collected by the photoreceptor cleaning device 6Y.

Also, primary transfer biases to be applied respectively to the primary transfer roller 5M, 5C and 5K of the second unit 10M and subsequent units are controlled similarly to the primary transfer bias of the first unit.

In this manner, the intermediate transfer belt 20 having a yellow toner image transferred thereonto in the first unit 10Y is sequentially transported through the second to fourth units 10M, 10C and 10K, and toner images of respective colors are superposed and multi-transferred.

The intermediate transfer belt 20 having the four toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into contact with each other at a predetermined timing through a supply mechanism and a predetermined secondary transfer bias is applied to the support roller 24. The transfer bias applied at this time has the same (−) polarity as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing unit), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

In order to improve the smoothness of the image surface after the fixing, the surface of the recording paper P is preferably smooth, and for example, coated paper in which the surface of plain paper is coated with a resin and the like, art paper for printing and the like are suitably used.

The recording paper P in which fixing of a color image is completed is transported to an ejection portion, whereby a series of the color image formation operations end.

Process Cartridge and Toner Cartridge

A process cartridge according to the exemplary embodiment will be described.

The process cartridge according to the exemplary embodiment includes a developing unit, which accommodates the electrostatic charge image developer according to the exemplary embodiment and develops an electrostatic charge image formed on the surface of an image holding member as a toner image with the electrostatic charge image developer, and is detachable from the image forming apparatus.

In addition, the configuration of the process cartridge according to the exemplary embodiment is not limited thereto and may include a developing device and, additionally, one selected from other units such as an image holding member, a charging unit, an electrostatic charge image forming unit and a transfer unit as necessary.

Hereinafter, an example of the process cartridge according to the exemplary embodiment will be shown and the process cartridge is not limited thereto. Main parts shown in the drawing will be described and the descriptions of other parts will be omitted.

Figure 2:
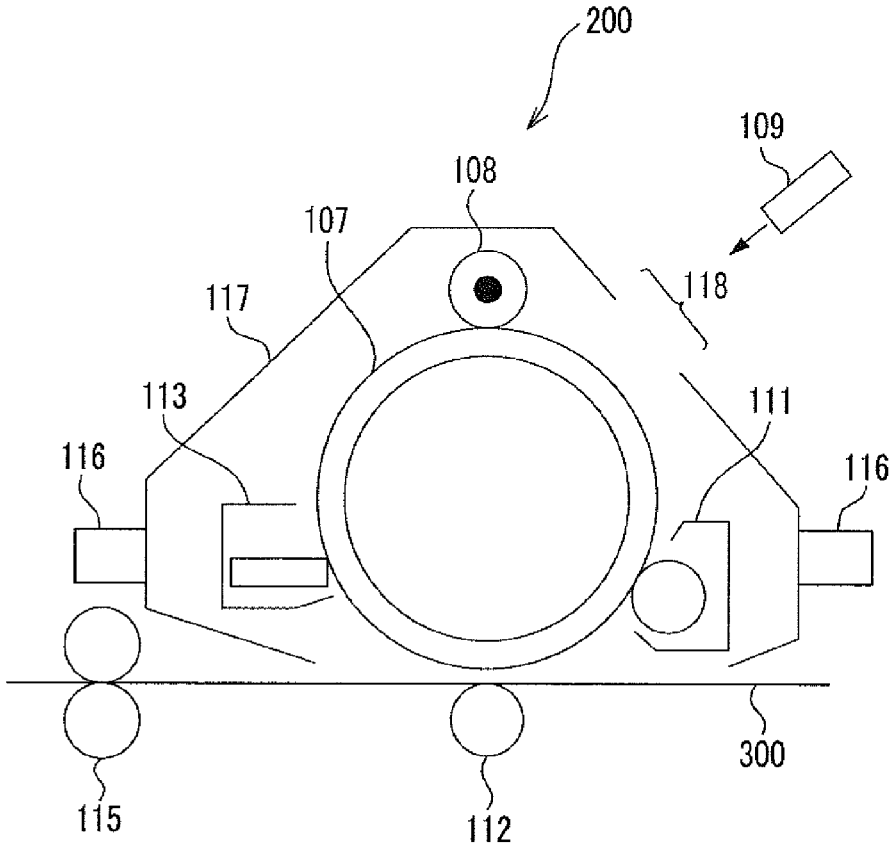
FIG. 2 shows a schematic configuration diagram of an example of a process cartridge according to an exemplary embodiment.

FIG. 2 shows a schematic configuration diagram of the process cartridge according to the exemplary embodiment.

A process cartridge 200 shown in FIG. 2 includes, a photoreceptor 107 (an example of the image holding member), a charging roller 108 (an example of the charging unit) provided in the periphery of the photoreceptor 107, a developing device 111 (an example of the developing unit) and a photoreceptor cleaning device 113 (an example of the cleaning unit), all of which are integrally combined and supported, for example, by a housing 117 provided with a mounting rail 116 and an opening portion 118 for exposure to form a cartridge.

Then, in FIG. 2, 109 denotes an exposure device (an example of the electrostatic charge image forming unit), 112 denotes a transfer device (an example of the transfer unit), 115 denotes a fixing device (an example of the fixing unit), and 300 denotes recording paper (an example of the recording medium).

Next, a toner cartridge according to the exemplary embodiment will be described.

The toner cartridge according to the exemplary embodiment is a toner cartridge which is detachable from the image forming apparatus and accommodates the toner according to the exemplary embodiment therein. The toner cartridge accommodates the toner for replenishment in order to supply the toner to the developing unit provided in the image forming apparatus.

The image forming apparatus shown in FIG. 1 is an image forming apparatus having a configuration in which the toner cartridges 8Y, 8M, 8C and 8K are detachably attached, and the developing devices 4Y, 4M, 4C, and 4K are connected to toner cartridges corresponding to the respective developing devices (colors) via a toner supply pipe (not shown). Also, in the case where the toner accommodated in the toner cartridge runs low, the toner cartridge is replaced.

EXAMPLES

The exemplary embodiments are more specifically described below with reference to the following Examples and Comparative Examples, but it should be construed that the exemplary embodiments are not limited to these Examples. Incidentally, in the following description, "parts" and "%" represent "parts by weight" and "% by weight", respectively unless otherwise indicated.

External Additive

External Additive 1

Preparation Process (Preparation of Alkali Catalyst Solution (1))

250 parts by weight of methanol and 45 parts by weight of 10% aqueous ammonia are put in a glass reaction container having a stirring blade, a dropping nozzle and a thermometer, and are stirred and mixed, thereby obtaining an alkali catalyst solution (1). The ratio of the ammonia catalyst amount to the $NH_3$ amount ($NH_3$[mol]/($NH_3$+methanol+water) [L]) in the alkali catalyst solution (1) at this time is 0.66 mol/L.

Particle Formation Process (Preparation of Silica Particle Suspension (1))

First Supply Process

Next, a temperature of the alkali catalyst solution (1) is adjusted to 30° C., and the alkali catalyst solution (1) is substituted with nitrogen. Thereafter, while stirring the alkali catalyst solution (1) at a rate of 120 rpm, tetramethoxysilane (TMOS) and aqueous ammonia having a catalyst ($NH_3$) concentration of 3.7% are added dropwise at the flow rates of 4 parts by weight/min and 2.4 parts by weight/min respectively to start the supply thereof at the same time.

At the time when 1.5 min elapses after the start of the supply of the tetramethoxysilane and the aqueous ammonia, the supply of the tetramethoxysilane and the aqueous ammonia is stopped at the same time. The amount of tetramethoxysilane supplied at the time when the supply of the tetramethoxysilane and the aqueous ammonia is stopped is 0.0024 mol/mol with respect to the amount of the alcohol added to the reaction container in the preparation process.

Maturing Process

The supply stopping time of tetramethoxysilane and the aqueous ammonia is 1 min.

Second Supply Process

After 1 min elapses from the supply stop of the tetramethoxysilane and the aqueous ammonia, the supply of the tetramethoxysilane and the aqueous ammonia is restarted. At the time of supply, adjustment is performed so that the flow rates of the tetramethoxysilane and the aqueous ammonia are 4 parts by weight/min and 2.4 parts by weight/min, respectively, and the tetramethoxysilane and the aqueous ammonia are then added dropwise.

The total addition amount of the tetramethoxysilane and the 3.7% aqueous ammonia in the entire processes including the first supply process and the second supply process is 90 parts by weight of the tetramethoxysilane and 54 parts by weight of the 3.7% aqueous ammonia.

After the dropwise addition of 90 parts by weight of the tetramethoxysilane and 54 parts by weight of the 3.7% aqueous ammonia, a silica particle suspension is obtained.

Solvent Removal and Drying

Thereafter, 150 parts by weight of the solvent of the obtained silica particle suspension is distilled away by heating distillation, 150 parts by weight of the pure water is added, and drying is then performed by a freeze dryer, to thereby obtain irregular-shaped hydrophilic silica particles.

Hydrophobization Treatment of Silica Particles

Next, in the following manner, the hydrophobization treatment of the hydrophilic silica particles is performed. In the hydrophobization treatment, an apparatus equipped with a carbon dioxide cylinder, a carbon dioxide pump, an autoclave with a stirrer and a back pressure valve is used.

First, 20.0 parts by weight of an obtained powder of hydrophilic silica particles are put in the autoclave, and then, 6 parts by weight of hexamethyldisilazane (manufactured by Wako Pure Chemical Industries, Ltd.) are put. Then, the autoclave is filled with liquefied carbon dioxide. The temperature is increased to 170° C. by a heater, and then a pressure is increased to 20 MPa by the carbon dioxide pump. The stirrer is operated at a rate of 200 rpm and the materials therein are kept for 30 minutes. After the hydrophobization treatment, the pressure is released to atmospheric pressure by the back pressure valve and the material is cooled to room temperature (25° C.). Thereafter, the stirrer is stopped to take out a powder of hydrophobic silica particles subjected to the hydrophobization treatment from the autoclave.

The obtained powder of the sol-gel silica particles is set as the external additive 1.

External Additives 2 to 12

Sol-gel silica particles are produced in the same manner as the external additive 1 to obtain external additives 2 to 12 except that the amount of the alkali catalyst, the supply time, the supply stopping time and the amount of TMOS during the supply stopping time are changed according to Table 1.

The external additives 2 to 12 are subjected to the hydrophobization treatment using supercritical carbon dioxide in the same manner as the external additive 1.

Toner Particles

Toner Particles 1

Production of Toner Particles 1 (Aggregated and Coalesced Particles)

Preparation of Resin Dispersion 1

Ethylene glycol (manufactured by Wako Pure Chemical Industries, Ltd.): 37 parts by weight Neopentyl glycol (manufactured by Wako Pure Chemical Industries, Ltd.): 65 parts by weight 1,9-Nonanediol (manufactured by Wako Pure Chemical Industries, Ltd.): 32 parts by weight Terephthalic acid (manufactured by Wako Pure Chemical Industries, Ltd.): 96 parts by weight The aforementioned monomers are put in a flask, the temperature is increased to 200° C. over 1 hour, and after it is confirmed that the inside of the reaction system is uniformly stirred, 1.2 parts by weight of dibutyltin oxide is added thereto. Furthermore, the temperature is increased from the aforementioned temperature to 240° C. over 6 hours while distilling away produced water, and a dehydration condensation reaction is further continued at 240° C. for 4 hours, thereby obtaining a polyester resin having an acid value of 9.4 mgKOH/g, a weight average molecular weight of 13,000 and a glass transition temperature of 62° C.

Next, while maintaining the molten state, the polyester resin is transferred to Cavitron CD 1010 (manufactured by EUROTEC LIMITED) at a rate of 100 parts per minute. A diluted aqueous ammonia having a concentration of 0.37%, which is obtained by diluting aqueous ammonia as a test reagent with ion exchange water, is put in an aqueous medium tank which is separately provided, and under heating to 120° C. with a heat exchanger, is transferred to Cavitron at a rate of 0.1 L per minute, simultaneously with the molten polyester resin. Cavitron is operated at a rotation rate of a rotor of 60 Hz and a pressure of 5 kg/cm$^2$, thereby obtaining a resin dispersion with the polyester resin particles having a volume average particle size of 160 nm, a solid content of 30%, a glass transition temperature of 62° C. and a weight average molecular weight of 13,000 dispersed therein.

Preparation of Resin Dispersion 2

Styrene (manufactured by Wako Pure Chemical Industries, Ltd.): 290 parts by weight n-Butyl acrylate (manufactured by Wako Pure Chemical Industries, Ltd.): 104 parts by weight Acrylic acid (manufactured by Wako Pure Chemical Industries, Ltd.): 6 parts by weight Dodecanethiol (manufactured by Wako Pure Chemical Industries, Ltd.): 10 parts by weight Divinyl adipate (manufactured by Wako Pure Chemical Industries, Ltd.): 1.6 parts by weight The aforementioned monomers are mixed, and while the mixture is added to a solution in which 8 parts by weight of anionic surfactant (NEOGEN SC, manufactured by Dai-ichi Kogyo Seiyaku Co., Ltd.) is dissolved in 550 parts by weight of ion exchange water, dispersed in a flask and emulsified. While the resultant is mixed slowly for 10 minutes, 61 parts by weight of ion exchange water in which 8 parts by weight of ammonium persulphate (manufactured by Wako Pure Chemical Industries, Ltd.) is dissolved is added and substitution with the nitrogen is performed at 0.1 L/min for 20 minutes. Then, while stirring is performed in the flask, the contents are heated to 70° C. by an oil bath and emulsion polymerization is performed continuously for 5 hours. Thus, a resin dispersion 2 having a solid content of 40% is prepared. After some of the dispersion is kept in an oven at 100° C. to remove moisture and differential scanning calorimetry (DSC) is performed, the glass transition temperature is 51° C. and the weight average molecular weight is 30,000.

Preparation of Colorant Dispersion

Cyan pigment (Pigment Blue 15:3, manufactured by Dainichiseika Color & Chemicals Mfg. Co., Ltd): 10 parts by weight Anionic surfactant (NEOGEN SC, manufactured by Dai-ichi Kogyo Seiyaku Co., Ltd.): 2 parts by weight Ion exchange water: 80 parts by weight The aforementioned components are mixed and the mixture is dispersed for 1 hour using a high-pressure counter collision dispersing machine, ULTIMIZER (HJP30006, manufactured by Sugino Machine Ltd.), thereby obtaining a colorant dispersion having a volume average particle size of 180 nm and a solid content of 20%.

Preparation of Release Agent Dispersion

Carnauba wax (RC-160, melting temperature 84° C., manufactured by TOA KASEI Co., Ltd.): 50 parts by weight Anionic surfactant (NEOGEN SC, manufactured by Dai-ichi Kogyo Seiyaku Co., Ltd.): 2 parts by weight Ion exchange water: 200 parts by weight The aforementioned components are heated to 120° C., and the resulting mixture is mixed and dispersed using ULTRA TURRAX T50 (manufactured by IKA Works, Inc.). Then, the dispersion is subjected to a dispersion treatment using a pressure discharge type homogenizer, thereby obtaining a release agent dispersion having a volume average particle size of 200 nm and a solid content of 20%.

Resin Dispersion 1: 200 parts by weight

Colorant dispersion: 25 parts by weight

Release agent particle dispersion: 30 parts by weight

Polyaluminum chloride: 0.4 part by weight

Ion exchange water: 100 parts by weight

The aforementioned components are put in a stainless steel flask and mixed and dispersed using ULTRA TURRAX T50 (manufactured by IKA Works, Inc.). Thereafter, the dispersion is heated to 48° C. on an oil bath for heating while stirring the flask. After keeping the dispersion at 48° C. for 30 minutes, 30 parts by weight of the resin dispersion 2 is added thereto.

Then, after the pH in the system is adjusted to 8.0 using a sodium hydroxide aqueous solution having a concentration of 0.5 mol/L, the stainless steel flask is sealed, a seal of the stirring axis is magnetically sealed, and the solution is heated to 90° C. while continuing stirring, followed by keeping for 30 minutes. Then, the temperature and the pH are adjusted to 48° C. and 3.8, and 100 parts by weight of resin dispersion 2 is added. After the addition, the mixture is left for 30 minutes, then, the pH is adjusted to 8.0 again, and the stainless steel flask is sealed. The seal of the stirring axis is magnetically sealed, and the solution is heated to 93° C. while continuing stirring, followed by keeping for 4 hours.

Thereafter, the mixture is cooled at a temperature falling rate of 2° C./min, filtered and then washed with ion exchange water, followed by solid-liquid separation by Nutsche type suction filtration. The resultant is further redispersed in 3 L of ion exchange water at 30° C. and stirred and washed at 300 rpm for 15 minutes. This operation is further repeated six times, and when the filtrate has a pH of 7.54 and an electric conductivity of 6.5 μS/cm, solid-liquid separation is performed using a No. 5A filter paper by Nutsche type suction filtration. Subsequently, vacuum drying is continued for 12 hours, thereby obtaining toner particles 1.

As a result of measuring the volume average particle size 050v of the toner particles 1 using a Coulter counter, it is found that the volume average particle size is 5.8 μm and the SF1 is 130.

Toner Particles 2

Toner particles are produced in the same manner as the toner particles 1 except that the resin dispersion 2 is not added thereby obtaining toner particles 2 not having a coating layer containing a vinyl resin.

Example 1

Production of Toner

Using a Henschel mixer, 1.5 parts by weight of the external additive 1 and 0.8 part by weight of hydrophobic silica (R972, manufactured by Nippon Aerosil Co., Ltd.) with respect to 100 parts by weight of the toner particles 1 are added and mixed at a circumferential rate of 30 m/s for 3 minutes to produce a toner.

Production of Electrostatic Charge Image Developer Production of Carrier

Ferrite Particles (average particle size: 50 μm): 100 parts by weight

Toluene: 14 parts by weight

Styrene methacrylate copolymer (component ratio: 90/10):2 parts by weight

Carbon black (R330: manufactured by Cabot Corporation) 0.2 part by weight

First, the aforementioned components except the ferrite particles are stirred for 10 minutes by a stirrer to prepare a dispersed coating solution. Next, the coating solution and the ferrite particles are put in a vacuum degassing kneader, stirred for 30 minutes at a temperature of 60° C., and then depressurized while further heated so as to remove gas and dry the solution, thereby producing a carrier.

4 parts by weight of the toner and 96 parts by weight of the carrier are stirred for 20 minutes at a rate of 40 rpm using a V blender, the mixture is sieved using a 250 μm mesh sieve, thereby producing an electrostatic charge image developer.

Evaluation

The obtained external additive, toner and electrostatic charge image developer are evaluated as follows.

The results are shown in Table 2.

Properties of External Additive

In the obtained toner, the volume average particle size, average circularity and Da/H ratio of the external additive (silica particles) are measured by the aforementioned method.

Image Quality

As the image quality evaluation, foaming in an image is observed as follows.

First, a developer unit of an image forming apparatus "a modified machine of ApeosPort-IV C5575" (manufactured by Fuji Xerox Co., Ltd.) is filled with the obtained electrostatic charge image developer.

Next, using the apparatus, under the conditions of 30° C., a high humidity of 90% RH and a fixing temperature of 160° C., an image is formed on copy paper (J paper) (manufactured by Fuji Xerox Co., Ltd.). The image is a solid image having an image density of 100% with a size of 5 cm×10 cm.

In a tip end region (an end on the side running into a fuser and a region of from the tip end to 0.5 cm) of a first output solid image, an image defect is visually observed. The evaluation criteria are as follows.

A: No image defect is observed.

B: Gloss is slightly lower than that of other regions.

C: Little trace of foaming is observed.

D: Trace of foaming is observed.

The evaluation results of A to C have no practical problem.

Low-temperature Fixing Properties

A modified machine of Color Docutech-60 (manufactured by Fuji Xerox Co., Ltd.) is filled with the obtained electrostatic charge image developer and a solid image is formed on copy paper (J paper) (manufactured by Fuji Xerox Co., Ltd.) so as to have a toner amount of 0.9 mg/cm$^2$. The image is fixed with a nip width of 6.5 mm and at a fixing rate of 220 mm/sec to evaluate the low-temperature fixing properties. In the evaluation, after producing a fixed image at each fixing temperature by changing the fuser temperature from 100° C. to 200° C. at an interval of 10° C., the degree of peeling of the image in the folded part obtained by valley-folding the image surface of each fixed image obtained is observed, and the width of the paper expressed in the folded part resulting from peeling of the image is measured. The fixing temperature at which the width becomes 0.5 mm or less is set as a minimum fixing temperature (MFT, ° C.). The evaluation criteria are as follows.

A: MFT is 120° C. or lower, and low-temperature fixing properties are exerted.

B: MFT is 135° C. or lower, and low-temperature fixing properties are slightly poor.

C: MFT is 150° C. or lower, and low-temperature fixing properties are poor.

D: MFT is higher than 150° C., and the toner does not have low-temperature properties.

The evaluation results of A to C have no practical problem.

Examples 2 to 10

Toners and electrostatic charge image developers are produced in the same manner as in Example 1 except that the external additive is changed according to Table 2 and the same evaluation as in Example 1 is performed. The results are shown in Table 2.

Comparative Examples 1 to 3

Toners and electrostatic charge image developers are produced in the same manner as in Example 1 except that the external additive and the toner particle are changed according to Table 2 and the same evaluation as in Example 1 is performed. The results are shown in Table 2.

TABLE 1

| | | Properties | | | First supply process | | | |
|---|---|---|---|---|---|---|---|---|
| | Kinds | Volume average Particle Size (nm) | Average circularity | Da/H ratio | Supply time (min) | TMOS amount (mol/mol) to methanol during supply stopping time | Maturing process Supply stopping time (min) | Amount of alkali catalyst (mol/L) |
| External additive 1 | Sol-gel silica | 120 | 0.76 | 1.51 | 1.0 | 0.0024 | 1.5 | 0.66 |
| External additive 2 | Sol-gel silica | 125 | 0.81 | 1.52 | 1.0 | 0.0044 | 1.5 | 0.66 |
| External additive 3 | Sol-gel silica | 115 | 0.89 | 1.88 | 1.5 | 0.0076 | 1.5 | 0.65 |
| External additive 4 | Sol-gel silica | 75 | 0.82 | 1.55 | 2.0 | 0.0048 | 1.0 | 0.63 |
| External additive 5 | Sol-gel silica | 190 | 0.81 | 1.52 | 5.0 | 0.0044 | 1.5 | 0.69 |
| External additive 6 | Sol-gel silica | 85 | 0.82 | 1.55 | 2.0 | 0.0048 | 1.5 | 0.64 |
| External additive 7 | Sol-gel silica | 145 | 0.85 | 1.66 | 4.0 | 0.0060 | 1.5 | 0.67 |
| External additive 8 | Sol-gel silica | 65 | 0.84 | 1.62 | 1.5 | 0.0056 | 1.0 | 0.63 |
| External additive 9 | Sol-gel silica | 210 | 0.88 | 1.82 | 5.5 | 0.0072 | 2.0 | 0.71 |
| External additive 10 | Sol-gel silica | 120 | 0.80 | 1.56 | 1.5 | 0.0042 | 1.0 | 0.66 |
| External additive 11 | Sol-gel silica | 125 | 0.73 | 1.48 | 6.0 | 0.0012 | 3.0 | 0.66 |
| External additive 12 | Sol-gel silica | 120 | 0.92 | 2.09 | 0.5 | 0.0088 | 1.5 | 0.66 |

TABLE 2

| | External additives | Toner particles | Image defect | Low-temperature fixing properties |
|---|---|---|---|---|
| Example 1 | External additive 1 | Toner particles 1 | C | B |
| Example 2 | External additive 2 | Toner particles 1 | B | B |
| Example 3 | External additive 3 | Toner particles 1 | B | B |
| Example 4 | External additive 4 | Toner particles 1 | B | B |
| Example 5 | External additive 5 | Toner particles 1 | B | B |
| Example 6 | External additive 6 | Toner particles 1 | B | B |
| Example 7 | External additive 7 | Toner particles 1 | A | A |
| Example 8 | External additive 8 | Toner particles 1 | A | C |
| Example 9 | External additive 9 | Toner particles 1 | A | C |
| Example 10 | External additive 10 | Toner particles 1 | B | A |
| Comparative Example 1 | External additive 11 | Toner particles 1 | D | B |
| Comparative Example 2 | External additive 12 | Toner particles 1 | D | C |
| Comparative Example 3 | External additive 1 | Toner particles 2 | D | A |

From the above results, it is apparent that foaming in the images of Examples is prevented from occurring in comparison with the images of Comparative Examples. In addition, in Examples, low-temperature fixing properties are maintained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle including a core particle containing a polyester resin and a coating layer containing a vinyl resin that coats the surface of the core particle; and an external additive that is formed of silica particles having an average circularity of from 0.88 to 0.89 and an average value of ratios of circle equivalent diameters Da obtained by a plane image analysis to the maximum height H obtained by a stereoscopic image analysis of more than 1.5 and less than 1.9.

2. The electrostatic charge image developing toner according to claim 1, wherein a volume average particle size of the silica particles is from 70 nm to 200 nm.

3. The electrostatic charge image developing toner according to claim 1, wherein the silica particles are sol-gel silica particles.

4. The electrostatic charge image developing toner according to claim 1, wherein an amount of the silica particles externally added is from 0.1 part by weight to 3.0 parts by weight with respect to 100 parts by weight of the toner particles.

5. The electrostatic charge image developing toner according to claim 1, wherein the coating layer is formed by heating a mixture of the core particles and a coating layer forming material in a dried state.

6. The electrostatic charge image developing toner according to claim 1, wherein a weight average molecular weight (Mw) of the vinyl resin is from 5,000 to 100,000.

7. The electrostatic charge image developing toner according to claim 1, wherein a weight average molecular weight (Mw) of the polyester resin is from 5,000 to 1,000,000.

8. The electrostatic charge image developing toner according to claim 1, wherein a molecular weight distribution Mw/Mn of the polyester resin is from 1.5 to 100.

9. The electrostatic charge image developing toner according to claim 1, further comprising:

a release agent, wherein a melting temperature of the release agent is from 50° C. to 110° C.

10. The electrostatic charge image developing toner according to claim 1, wherein a volume average particle size (D50v) is from 2 μm to 10 μm.

11. The electrostatic charge image developing toner according to claim 1, wherein a shape factor SF1 is from 110 to 150.

12. An electrostatic charge image developer comprising the electrostatic charge image developing toner according to claim 1.

13. A toner cartridge that accommodates the electrostatic charge image developing toner according to claim 1 and is detachable from an image forming apparatus.

* * * * *